US005415915A

United States Patent [19]

Oh

[11] Patent Number: 5,415,915

[45] Date of Patent: May 16, 1995

[54] CORNER REINFORCEMENT WITH EYELET FOR CLOTH

[75] Inventor: Sei-Yoon Oh, Seoul, Rep. of Korea

[73] Assignee: Korea Tarpaulin Inc., Seoul, Rep. of Korea

[21] Appl. No.: 52,179

[22] Filed: Apr. 23, 1993

[30] Foreign Application Priority Data

Dec. 7, 1992 [KR] Rep. of Korea ..... 1992-24593

[51] Int. Cl.[6] ..... B32B 3/10

[52] U.S. Cl. ..... 428/99; 428/137; 428/167; 135/119

[58] Field of Search ..... 428/99, 63, 80, 131, 428/137, 156, 167; 135/119

[56] References Cited

U.S. PATENT DOCUMENTS 4,439,378 3/1984 Ovard ..... 428/131

4,937,108 6/1990 Crisp et al. ..... 428/131

*Primary Examiner*—Alexander S. Thomas

*Attorney, Agent, or Firm*—Morgan & Finnegan

[57] ABSTRACT

A corner reinforcement for cloth is disclosed. This reinforcement comprises upper and lower plates for covering the upper and lower surfaces of the corner and reinforcing this corner. These upper and lower plates are integrally formed with each other in a single injection molding and have the same right-angled triangular appearance so as to provide a twofold right-angled triangular structure. This triangular structure of the reinforcement is opened at its hypotenuse but closed at the remaining sides thereof, thereby preventing the corner of cloth from jutting out of the reinforcement after fastening the reinforcement to the corner of cloth. The upper and lower plates each has an opening for a pitching rope and they are integrally formed with annular protrusions or eyelets which are adapted to reinforce the upper and lower plates against pull of the rope tied thereto. The reinforcement further includes grooves and protrusions to clamp the corner of cloth. These grooves and protrusions are provided at inner surfaces of the upper and lower plates.

6 Claims, 7 Drawing Sheets

CORNER REINFORCEMENT WITH EYELET FOR CLOTH

BACKGROUND OF THE INVENTION

1. Field of the Invention

The present invention relates in general to a reinforcement for cloth, and more particularly to a corner reinforcement with an integral eyelet for use with fabric tents and the like.

2. Description of the Prior Art

Conventionally, a fabric tent is pitched with the aid of a plurality of tent poles and ropes in such a manner that it is set up by erecting the tent poles, stretching ropes connected to individual corners of the tent and tying these ropes to tent pegs. In order to connect the ropes to the corners of the tent, the tent is generally provided at its corners with rope holes which are reinforced with grommets, preferably made of metal or plastic materials.

However, since each of the ropes 21 is always stretched in a direction in order to maintain the tensioned shape of the tent as depicted in FIG. 1, the grommet 22 is pulled in the same direction and this causes the woven cloth 11 about the rope hole to be deformed and ravelled. In this regard, this type of rope hole has a disadvantage in that the reinforcing grommet 22 provided at the rope hole easily comes off.

In an effort to solve this disadvantage, U.S. Pat. No. 4,777,071 proposed a stitchless reinforced corner structure for cloth. As depicted in FIGS. 2 to 4, this U.S. patent discloses a folding reinforcement 30 provided at a corner of a woven cloth 11 for preventing the deformation and ravelling of the cloth 11 about its rope hole. In application, this reinforcement 30 is added on a bottom surface of the corner of the woven cloth 11, and thereafter, folded at both flaps thereof to cover an upper surface of the corner in such a manner that two rope holes 31 of the reinforcement 30 overlap with the corresponding hole of the cloth 11. At this state, a conventional reinforcing grommet 22 is attached to the overlapped holes 31.

This type of corner structure, while somewhat preventing the grommet from coming off, nevertheless has a disadvantage in that it has the folding structure, which bears anxiety of being released under the possible excessive load, and keeps on requiring separate reinforcing grommets, thereby reducing the productivity.

SUMMARY OF THE INVENTION

It is, therefore, an object of the present invention to provide a corner reinforcement for cloth in which the above disadvantages can be overcome and which reinforces the corner of cloth with no stitchery and has an increased strength as well as the improved productivity.

It is another object of the present invention to provide a corner reinforcement for cloth which has an integrated eyelet substituting for conventional grommet and, as a result, achieves the desired reinforcing strength as well as lengthened life of cloth.

It is further object of the present invention to provide a corner reinforcement for cloth which improves the clamping force between the reinforcement and cloth by a plurality of clamping grooves and protrusions provided at opposite inner surfaces of twofold reinforcement.

In a preferred embodiment of this invention, the above objects can be accomplished by providing a corner reinforcement for cloth comprising an upper plate and a lower plate for covering the upper and lower surfaces of the corner respectively to reinforce this corner. These upper and lower plates are integrally formed with each other in a single injection molding and have the same right-angled triangular appearance so as to provide a twofold right-angled triangular reinforcement. This triangular structure of the reinforcement is opened at its hypotenuse but closed at the other two sides thereof, thereby preventing the corner of cloth from jutting out of the reinforcement after the reinforcement is fixed to the corner of cloth.

The upper and lower plates each has an opening for a pitching rope and they are integrally formed with eyelet halves which are adapted to reinforce the upper and lower plates at the openings against pull of the rope tied thereto.

The reinforcement further includes grooves and protrusions which are provided at the inner surfaces of the upper and lower plates and adapted for improving the clamping force of the reinforcement on the corner of cloth.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENTS

Figure 1:
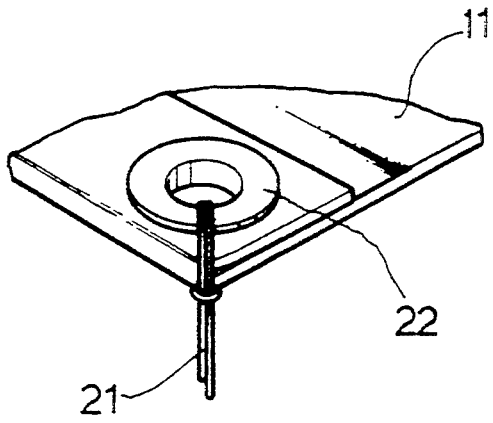
FIG. 1 is a view of a known reinforcement comprising a folded cloth corner and a grommet.
Figure 2:
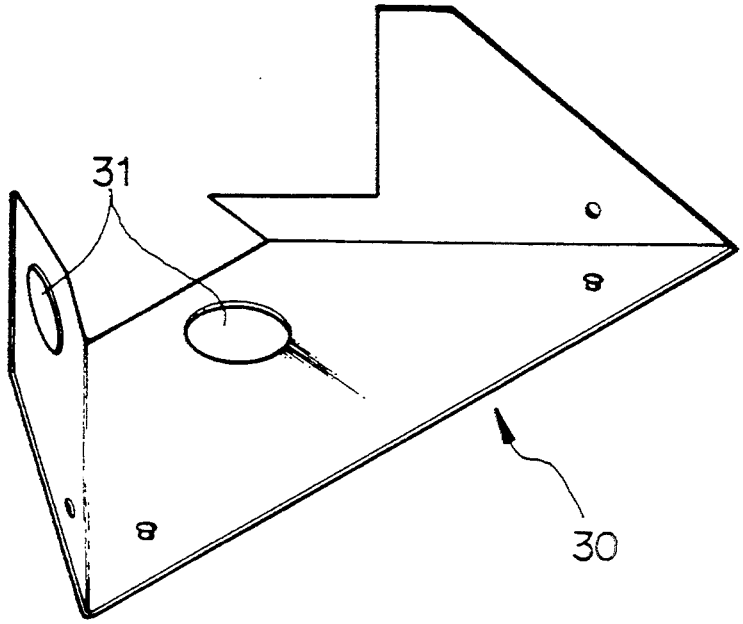
FIG. 2 shows another example of a reinforcement for the cloth corner before it is folded over and covers the corner portion.
Figure 3:
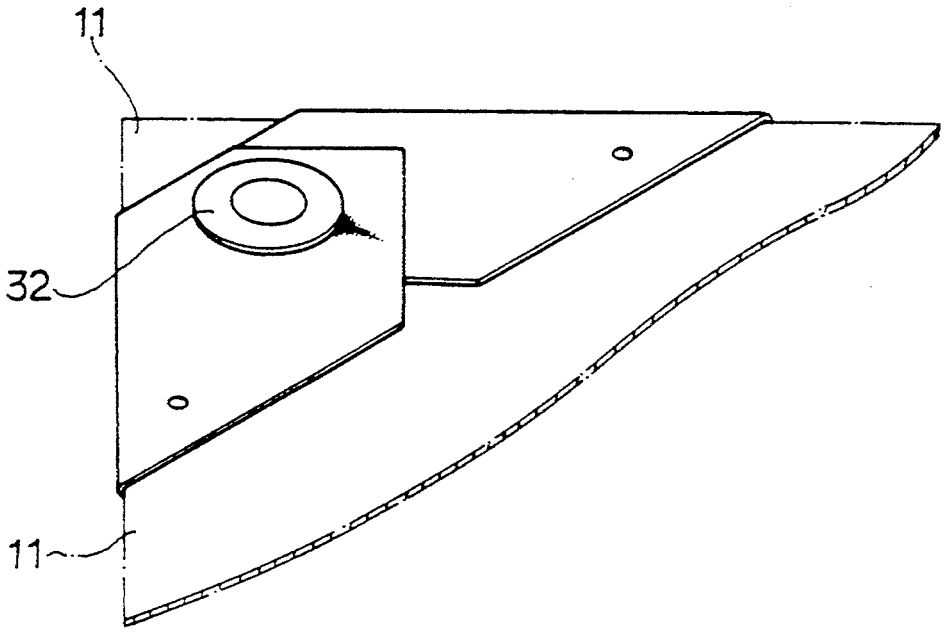
FIG. 3 is a perspective view of the reinforcement of FIG. 2 in its operation.
Figure 4:
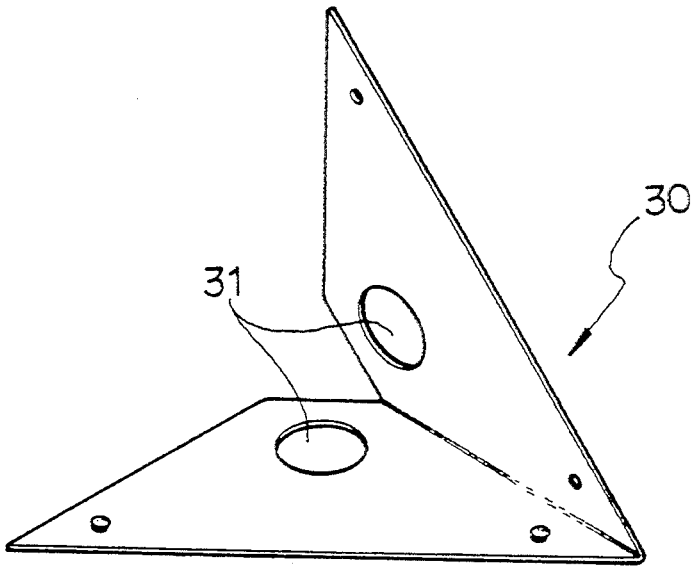
FIG. 4 is a perspective view of a modified embodiment of the reinforcement of FIG. 3.
Figure 5:
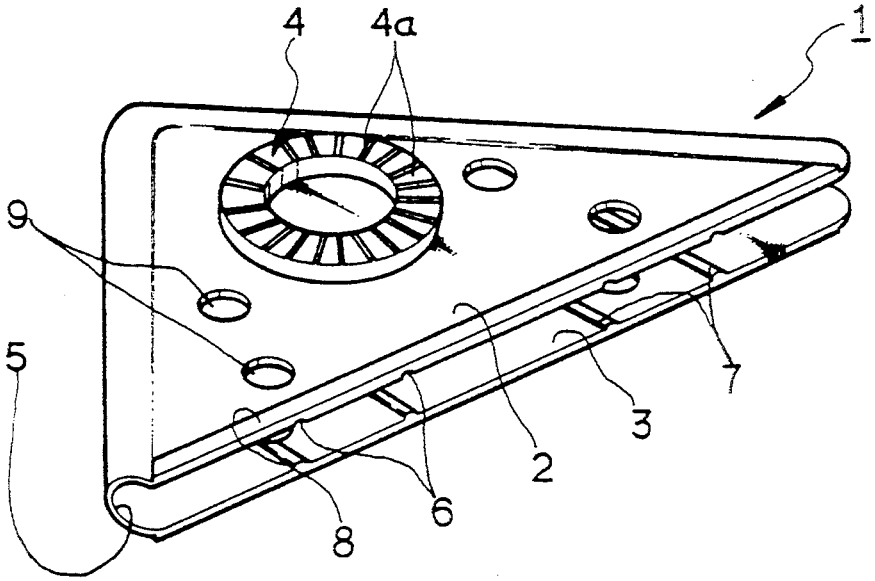
FIG. 5 is a perspective view of an embodiment of a cover reinforcement for cloth of this invention.

With reference to FIG. 5 showing an embodiment of this invention, a reinforcement 1 has a twofold structure having a right-angled triangular profile which matches the shape of the corner of cloth to be combined with this reinforcement 1. This twofold structure of the reinforcement 1 is accomplished by providing upper and lower plates 2 and 3 integrated with each other. This right-angled triangular structure of the reinforcement 1 is opened at its hypotenuse but closed at the other two sides thereof.

At the center of each of the upper and lower plates 2 and 3, there is formed an eyelet half 4 which has a jagged surface 4a but lacks the center hole for the simplification of the molding, although this hole may be formed simultaneously in the manufacturing process. The central holes of the eyelet halves may be pierced later in the course of fixing the reinforcement to the cloth corner. These eyelet halves 4 are integrally formed with the plates 2 and 3 and protrude from the outer surfaces of the plates 2 and 3, respectively. Both sides of the right-angled triangular structure are merged into connecting portions 5 each of which is arc-shaped in section, as depicted in detail in FIGS. 11 and 12, to give a good flexibility during the clamping process of the reinforcement 1.

Figure 9:
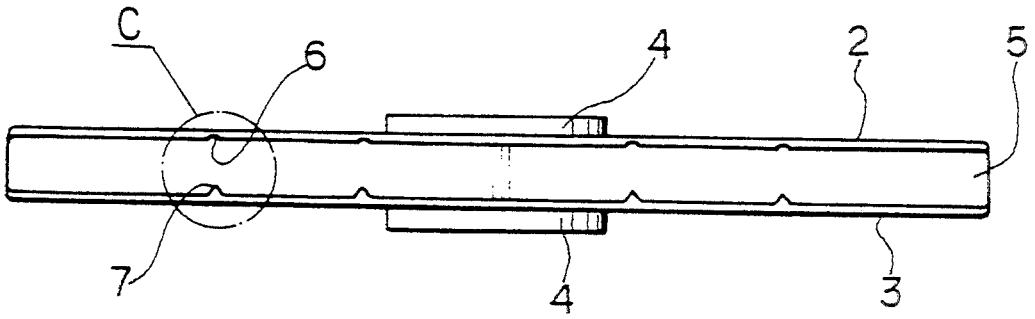
FIG. 9 is a front view of the reinforcement of FIG. 5.
Figure 10:
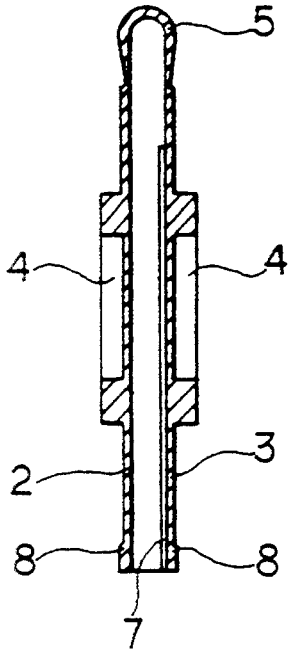
FIG. 10 is a sectional view of the reinforcement taken along the section line A—A of FIG. 6.
Figure 11:
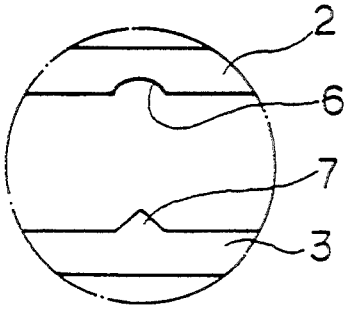
FIG. 11 is an enlarged view of the part C of FIG. 9.
Figure 12:
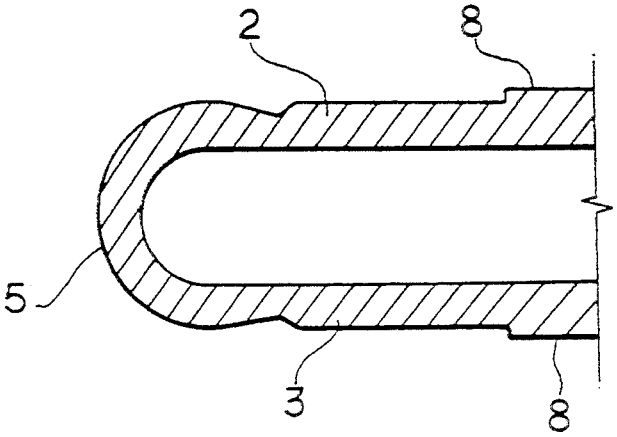
FIG. 12 is an enlarged sectional view of the reinforcement taken along the section line B—B of FIG. 6.
Figure 13:
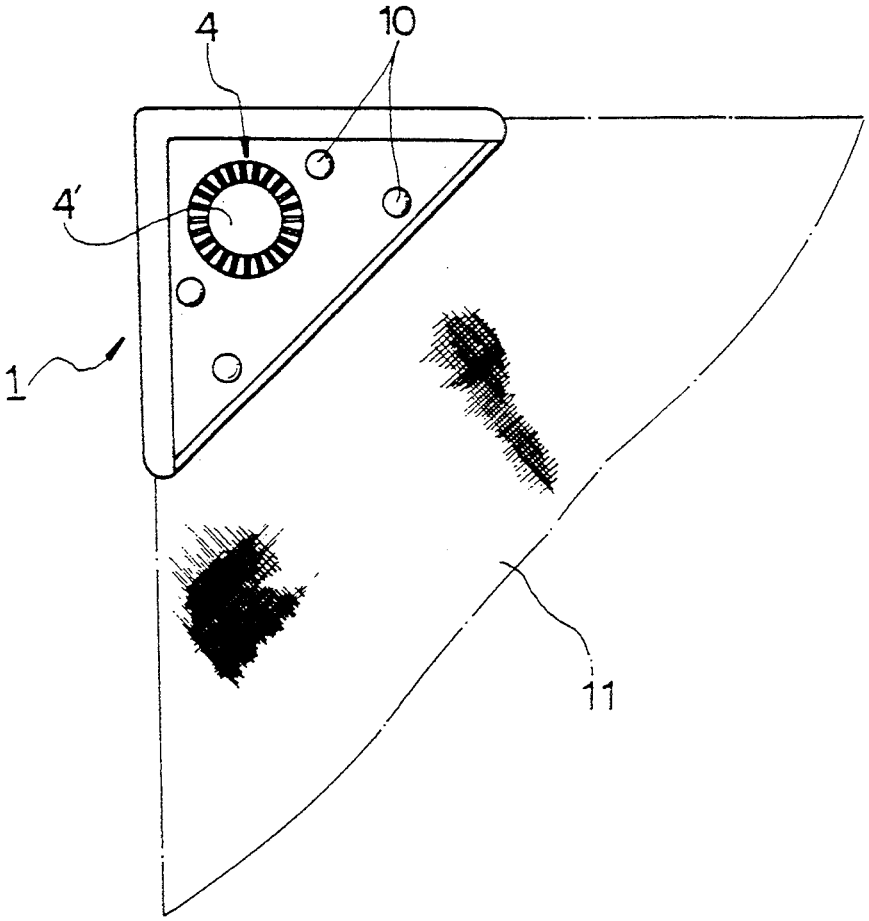
FIG. 13 is a plan view of the reinforcement of this invention fixed to a corner of cloth material.

The upper and lower plates 2 and 3 are provided, at their inner surfaces, with linear grooves 6 and linear protrusions 7, respectively, as shown in FIG. 9 and in an enlarged view of FIG. 11. The linear grooves 6 of the upper plate 2 face the individual linear protrusions 7 of the lower plate 3. Here, any desired number of grooves 6 and protrusions 7 may be formed on the inner surfaces of the plates 2 and 3 such that they are symmetrically arranged on both sides of the triangular plates 2 and 3 and there is a predetermined interval between the grooves 6 or the protrusions 7 formed on the plate 2 or 3. However, from the viewpoint of structure and size of the reinforcement 1 in practical use, it is preferred to have two grooves and two corresponding protrusions for each side of the reinforcement 1, otherwise stated, four grooves 6 and four protrusions 7 in total for the reinforcement 1.

The reinforcement 1 further includes linear protrusions 8 provided on the outer peripheries of the hypotenuses of the plates 2 and 3. These linear protrusions 8 are adapted to reinforce the plates 2 and 3. For the purpose of fastening operation, rivet holes 9 are formed on the upper and lower plates 2 and 3 at predetermined locations.

The reinforcement 1 with this structure can be molded by only a single injection molding process. The molded reinforcement 1 may be readily fastened to the cloth corner by putting the reinforcement 1 on the corner portion and then inseparably clamping thereto through rivetting at the holes 9 with the common rivets 10.

Figure 6:
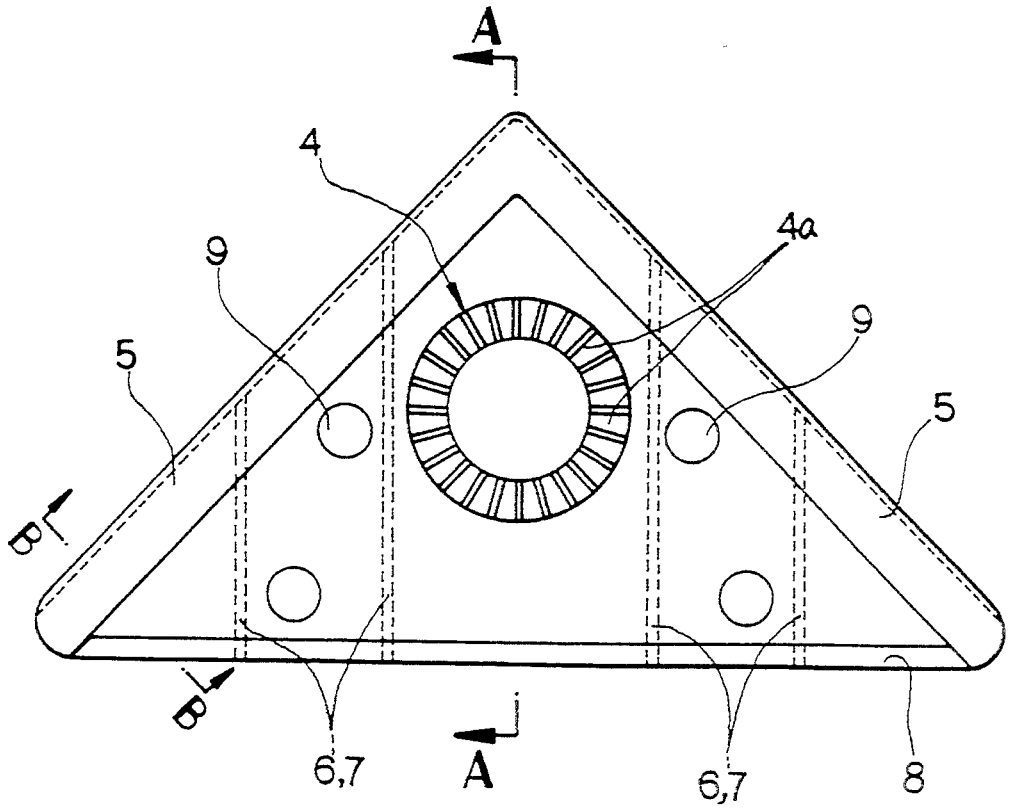
FIG. 6 is a plan view of the reinforcement of FIG. 5.

Specifically, the first embodiment shown in the plan view of FIG. 6 has four rivet holes 9 for each of the triangular plates 2 and 3, two being spaced at a distance near the hypotenuse and each one being located near the other sides of the triangle.

When the upper and lower plates 2 and 3 are tightly riveted on the upper and lower surfaces of the corner of cloth as described above, the woven cloth 11 about the corner is bitten by the grooves 6 and the protrusions 7 of the reinforcement 1 and this improves the clamping force between the woven cloth 11 and the reinforcement 1.

Figure 7:
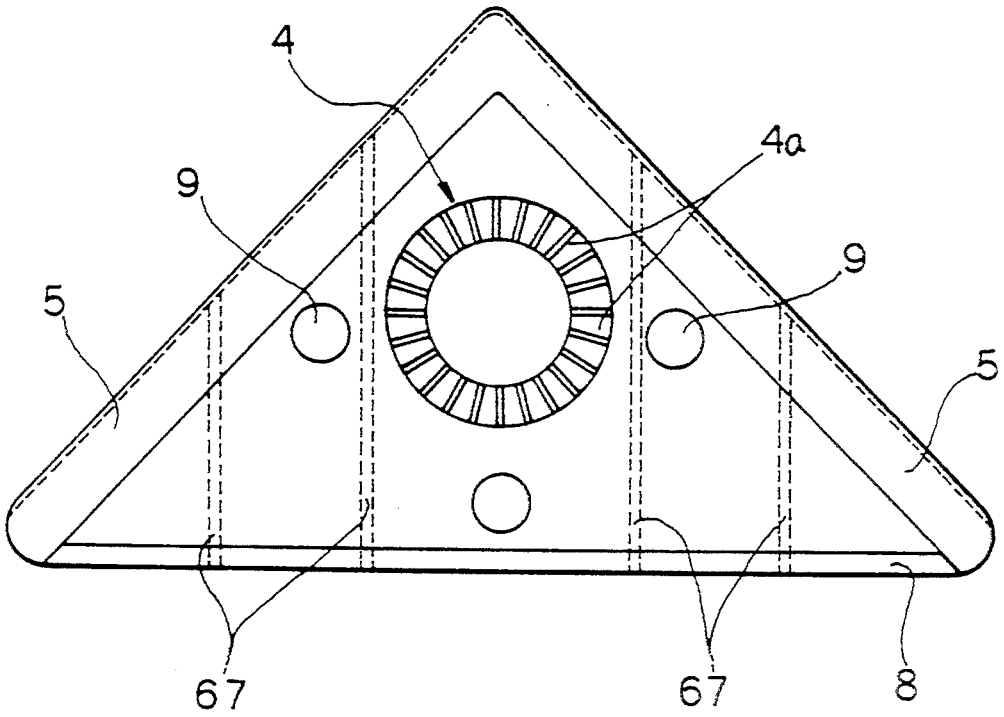
FIG. 7 is a view corresponding to FIG. 6, but showing the second embodiment of this invention.
Figure 8:
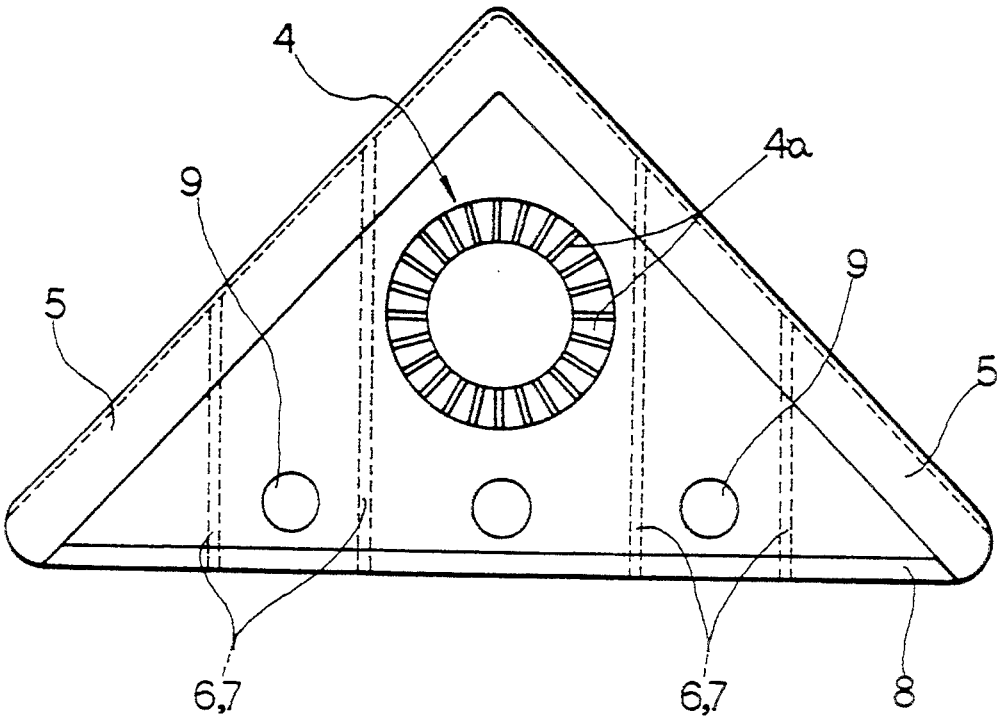
FIG. 8 is a view corresponding to FIG. 6, but showing the third embodiment of this invention.

In addition, the second embodiment of the present invention illustrated in FIG. 7 have the three rivet holes 9 each being located near the respective sides of the triangle. However, in accordance with second embodiment of this invention, each plate 2 or 3 may be provided with three rivet holes 9, two of which are formed at upper parts of the plate 2 or 3 and the other is formed at a lower center part of the plate 2 or 3 as shown in FIG. 7. Another embodiment of this invention having three rivet holes is depicted in FIG. 8. The rivet holes are formed in line near the hypotenuses of the triangular plates 2 and 3. In addition, the grooves 6 and the protrusions 7 may be formed such that all of the grooves 6 are formed at the upper plate 2, while all of the protrusions 7 are formed at the lower plate 3 as depicted in FIG. 9. However, it is possible to alternately form the grooves 6 and the protrusions 7 on each plate 2 or 3 so that the pairs of groove and protrusion are alternately provided in the reinforcement 1. When the grooves 6 and protrusions 7 are alternately arranged as described above, the clamping force between the cloth 11 and the reinforcement 1 will be improved in comparison with the primary embodiment of FIG. 9.

On the other hand, in order to provide a rope hole for the cloth 11 combined with the reinforcement 1, it is preferred to punch the circular parts inside the eyelet halves 4 of the reinforcement 1 to complete the eyelet with central hole after clamping this reinforcement 1 to the corner of the cloth 11. As a result, there is provided a circular rope hole 4' through the eyelet 4 and cloth. Of course, in still another embodiment of this invention, it is possible to form the central holes in the eyelet 4 at the same time of manufacture of this reinforcement 1 and to separately form a hole in the cloth 11 at a position corresponding to the central holes, thereby allowing the rope hole 4' to be provided when the clamping of the reinforcement 1 to the corner of cloth is accomplished.

Through the holes 4', an end of the rope may be passed and tied to the reinforcement 1, the other end of the rope being fastened to the place where the tent is to be pitched.

The reinforcement structured in accordance with the present invention eliminates the anxiety that the attached rope under the drag force will damage any part of the reinforcement and the corner of cloth being covered thanks, in particular, to the integral eyelet.

As described above, the reinforcement of the present invention can be simply manufactured in a single molding process and reduces the working time in its application to the cloth corner. Additionally, this reinforcement encloses the cloth corner with no exposure to give neat appearances to the corner portions of cloth being covered.

The integral eyelets 4 on the plates 2 and 3 provide an extra effect of lengthening the life of the reinforcement.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A corner reinforcement for cloth such as a tent material comprising:

a first plate generally shaped to match a corner of the cloth and including an opening for a pitching rope and a plurality of rivetting holes; and a second plate integrally formed to said first plate so that said first and second plates have a predetermined space therebetween and being connected to each other along their margins leaving an opening therebetween to allow the entry of the cloth corner, whereby said reinforcement covers said corner of cloth and may be fastened thereto by rivetting through said rivetting holes, wherein said first and second plates have the same right-angled triangular appearance so as to provide a twofold right-angled triangular structure, said triangular structure being closed at its two sides except the hypotenuse, thereby preventing said corner of the cloth from jutting out of said reinforcement after clamping said reinforcement to said corner of the cloth.

2. A corner reinforcement for cloth according to claim 1, wherein said first and second plates are each provided at said rope opening with an integral eyelet which is adapted to reinforce said first and second plates when said plates are pulled by said rope together with said corner of cloth being reinforced.

3. A corner reinforcement for cloth according to claim 1, wherein said first and second plates are provided at their margins forming said opening with thickened portions to give a strength to the margins.

4. A corner reinforcement for cloth according to claim 1, wherein said reinforcement further includes one or more pairs of grooves and protrusions formed on the inner surfaces of said first and second plates.

5. A corner reinforcement for cloth according to claim 4, wherein said grooves are formed on the inner surfaces of said first plate and the corresponding protrusions are formed on the inner surfaces of said second plate so that said grooves and protrusions are matched when said plates are pressed together.

6. A corner reinforcement for cloth according to claim 5, wherein said grooves and protrusions are alternately provided on each of said inner surfaces of said first and second plates.

* * * * *